US010081510B2

(12) United States Patent
Luo et al.

(10) Patent No.: US 10,081,510 B2
(45) Date of Patent: Sep. 25, 2018

(54) DEVICE AND METHOD FOR WINDING AND UNWINDING A PARALLEL WIRE STRAND HORIZONTALLY

(71) Applicants: Shanghai Pujiang Cable Co., Ltd., Shanghai (CN); Zhejiang Pujiang Cable Co., Ltd., Jiashan, Zhejiang (CN)

(72) Inventors: Guoqiang Luo, Shanghai (CN); Gang Li, Shanghai (CN); Hailiang Zhang, Shanghai (CN); Jinlin Zhu, Shanghai (CN); Qinghua Gu, Shanghai (CN); Fei Xie, Shanghai (CN)

(73) Assignees: SHANGHAI PUJIANG CABLE CO., LTD., Shanghai (CN); ZHEJIANG PUJIANG CABLE CO., LTD., Jiashan, Zhejiang (CN)

( * ) Notice: Subject to any disclaimer, the term of this patent is extended or adjusted under 35 U.S.C. 154(b) by 140 days.

(21) Appl. No.: 14/981,599

(22) Filed: Dec. 28, 2015

(65) Prior Publication Data

US 2016/0130108 A1 May 12, 2016

Related U.S. Application Data

(63) Continuation-in-part of application No. 13/991,304, filed as application No. PCT/CN2010/079953 on Dec. 17, 2010, now abandoned.

(51) Int. Cl.
*B65H 49/30* (2006.01)
*B65H 57/14* (2006.01)
(Continued)

(52) U.S. Cl.
CPC ..... *B65H 49/30* (2013.01); *B65H 49/28* (2013.01); *B65H 54/2821* (2013.01);
(Continued)

(58) Field of Classification Search
CPC ..... B65H 49/30; B65H 49/28; B65H 54/74; B65H 54/2821; B65H 57/006; B65H 57/14
(Continued)

(56) References Cited

U.S. PATENT DOCUMENTS 4,169,566 A * 10/1979 Boudouris ..... G03B 21/32 242/328.1
5,482,225 A * 1/1996 Hartwig ..... B21D 43/023 242/559.4
(Continued)

*Primary Examiner* — Sang K Kim
(74) *Attorney, Agent, or Firm* — Global IP Services; Tianhua Gu

(57) ABSTRACT

A device and method for horizontally winding and unwinding a parallel wire strand, the device includes guiding device, rotating platform, rail flat wagon, strand winding and unwinding device, tray, several transmitters and programmable controllers, according to different mounted characteristics of winding and unwinding wire strand, the strand winding and unwinding device is divided into two structure forms, that are first inner module and second inner module; first inner module is composed of supporting plate and top drawbar, second inner module is composed of supporting plate and top drawbar, in addition knockout pin of hydraulic jack, can commendably solve "Hula-circles" problem.

8 Claims, 5 Drawing Sheets

(51) Int. Cl.

| | |
|---|---|
| ***B65H 49/28*** | (2006.01) |
| ***B65H 54/28*** | (2006.01) |
| ***B65H 54/74*** | (2006.01) |
| ***B65H 57/00*** | (2006.01) |

(52) U.S. Cl.
CPC ..... *B65H 54/74* (2013.01); *B65H 57/006* (2013.01); *B65H 57/14* (2013.01); *B65H 2701/36* (2013.01)

(58) Field of Classification Search
USPC ..... 242/130.2, 406, 597.7
See application file for complete search history.

(56) References Cited

U.S. PATENT DOCUMENTS

| | | | | |
|---|---|---|---|---|
| 5,535,956 | A * | 7/1996 | Irmen | B65H 67/064 242/130.2 |
| 2006/0196988 | A1 * | 9/2006 | Kurzyniec | B65D 85/04 242/588.2 |

* cited by examiner

DEVICE AND METHOD FOR WINDING AND UNWINDING A PARALLEL WIRE STRAND HORIZONTALLY

CROSS REFERENCE TO RELATED PATENT APPLICATION

The present application is a continuation in part of the application of U.S. Ser. No. 13/991,304 filed Jun. 3, 2013, which is a US national stage application of the PCT/CN2010/079953 filed Dec. 17, 2010. The present application claims the domestic priorities of the U.S. Ser. No. 13/991,304 and PCT/CN2010/079953. The U.S. Ser. No. 13/991,304 is incorporated herein by reference.

FIELD OF THE INVENTION

The present invention relates to a winding/unwinding device and operating method specialized in winding, storage, unwinding, transport or repeated use of the strands. More particularly it pertains to a device and method for horizontally winding and unwinding a parallel wire strand comprising multiple twisted metal wires (also referred to as threads) of all kinds of length, thin or fine thread like materials.

BACKGROUND OF THE INVENTION

The main cable strands are the chief bearing members of suspension bridge. The cable strand is made of high strength galvanized wire of 5 mm in diameter. Formerly specifications for the cable strand were available in 61 wires, 91 wires and 127 wires. At present the over-length large main cable strands reach 5000 m in length, in 169 wires of 5 mm diameter. The weight of a cable strand reaches 120 tons. Commonly the cross-section of cable strand is regular hexagon. Some special cable strands may be rectangular or other shapes. A cable strand is bound with composite material bands at interval of 1.5 m~2 m. Traditionally, the winding of main cable strands of suspension bridge all applied large diameter steel reels for winding horizontal parallel wire strands at home and abroad. This process is called by reel processing for short. The one of the characteristics of reel processing was that the manufacturing, shipping and unwinding of cable strands all could not get rid of large diameter steel reel. During the transportation of cable strands on steel reels to large bridge building site, cable strands 10 could give birth to oval traumas from falling down shown in FIG. 1, owing to their deadweight. Consequently the cable strands oval traumas from falling down therefore caused cable strand winding loosen and friction between cable strands generated by steel reel rotating. While cable strands were winding along with steel reel rotating continually, this kind of trauma from falling down could result in so-called "Hula-circles" effect, in consequence it disturbed the original arrangement order and could be very difficult to unwinding cable strand from steel reel. Further more, in unwinding cable strand the dragging and pulling forces suddenly made the loose cable strands to be tightened or loosened every now and then, which could aggravate the frictions between cable strands and scratch binding bands on strand until breakage and make cable strand steel wires incoherent. During the procedure of unwinding cable strands the "Hula-circles" which had emerged would become more and more bigger along with the unwinding process of cable strands, its loosen amount would increase gradually, and cable strand would collide with ground, until unwinding job implementation had no means of normal proceed. In order to remedy this phenomenon in construction site, in the traditional sense, it was necessary to reshape and bind strands continually by labor. Therefore the working machines should be shut down, after tightening cable strands wires, proceeded with unwinding strand for those already formative "Hula-circles". This not only brought unlimited inconvenience to assembly molding of main cable of suspension bridge, but also more seriously influence the time limit for a project. Particularly the longer the cable strand, the more serious the "Hula-circles" developed, furthermore the longer the cable strand, the more difficult the remedy measures carried out, even could not carry out. According to experiences under the precondition of holding good cable strand shape, adopting reel processing technology, commonly when cable strand length is over 1500 m, "Hula-circles" will be easy to appear during unwinding process of cable strand. When the "Hula-circles" phenomena become serious, it will direct influence site construction schedule and cable strand quality.

SUMMARY OF THE INVENTION

In order to overcome the defects of existing technology, at the same time be able to effectively increase working efficiency of winding and unwinding strand, the quantity of unwinding strand, as well as decrease work intensity, the present invention proposes a device and method for horizontally winding and unwinding a parallel wire strand.

The present invention achieves the invention objects through technical proposal as follows: provide a device for horizontally winding and unwinding wire strand, including: guiding device of strand, rotating platform, rail flat wagon, strand winding and unwinding device, tray, several transmitters and programmable controllers, said device is characterized comprising: said guide frame which is constituted by base and supporting frame, electric wire hoist fit on base, fixed pulley mounted at the top of the supporting frame, includes crane and lifting appliance composed of the strand transfer control mechanism set in the crane, a wire rope which connects from electric wire hoist to the top surface of crane bypass around fixed pulley, wherein the said strand transfer control mechanism includes roller and spacing wheel, wherein there are three rollers installed in the crane, and arranged in "品" character pattern, that is to say, the three connecting lines from each center of circle of three rollers make up of a triangle;

rotating platform is fitted on the ground by the side of guiding device, which includes the under-chassis, turning axle fixed to under-chassis centre, platform set on turning axle, platform rails which are laid on platform and connected to external rail T outside the platform, through several backup pieces surrounding said turning axle vertically set on the under-chassis are installed at the bottom surfaces of platform to constitute revolving wheels which assume contact connect and rolling support function therefrom;

rail flat wagon is a special car which is used for winding strand of cable strand, comprising: wheels and bedplate fit on upward side of wheel through supporting frame, and set located on platform rail through wheel, in order to remove wrapped cable strand through platform rail therefrom;

strand winding and unwinding device is equipped with two structure forms according to different installation characteristics for horizontally parallel wire strand winding and unwinding, that is to say, resulting first inner module used for horizontally parallel wire strand winding and second inner module used for horizontally parallel wire strand unwinding, wherein first inner module is composed of four pieces of bracing plate at least and four opposite top drawbar at least, wherein the bottom of bracing plate and upper surface of rail flat wagon bedplate are connected with bolts and hinges firmly, assuming cellular pattern arrangement and uniform distribution, in this installation form, there is a gap clearance between two adjacent bracing plates, and on both right and left sides of push pawl upper part, two drawbars which are used as lifting eye for removing push pawl are symmetrically fixed on top of each push pawl through hinges, after push pawl and rail flat wagon are fixed joint, the gravity center of each push pawl is located at outer side of respective hinge, whereas top section of each push pawl is outward dipping to a certain angular degree, wherein second inner module is composed of four supporting plates at least, four pair top drawbars at least, hydraulic jack and four pieces of pushing bar at least, wherein the bottom of supporting plate and upper end of platform are mounted with bolts and hinges and assume cellular pattern arrangement and uniform distribution; in this installation status, there is a gap clearance between two adjacent bracing plates, top drawbars are fixed on both right and left sides of push pawl upper part through hinges, after push pawl and platform are firmly connected, the gravity center of push pawl is located at inner side of respective hinge, forcing the top section of supporting plate to lean inward to a certain angular degree; hydraulic jack is fitted on platform of supporting plate centre, one end of pushing bar is connected with knockout-pin of hydraulic jack, the other end comes into contact with internal surface of center position of supporting plate, resisting each supporting plate therefrom;

said tray is a circular ring appear board which will be sit in bedplate of rail flat wagon in winding operation or directly sit in platform in unwinding operation, and fit outside of strand winding and unwinding device in both strand winding and unwinding operations, there are lifting points at the edge of tray, furthermore, in winding operation a water proof membrane cover will be laid on top surface of tray;

said transmitter including pressure sensor, velocity measurement encoder and altitude measurement encoder, wherein pressure sensor and velocity measurement encoder are set at one side of roller; altitude measurement encoder set at one side of fixed pulley;

Programmable controller is used for linking and controlling pressure sensor, velocity measurement encoder altitude measurement encoder as well as hauling wire rope to pull up crane of electric wire hoist.

The operating method of the device for horizontally winding and unwinding wire strand of present invention, including winding and unwinding wire strand operations, is possessed of 13 steps in all. The "Hula-circles" problem developed in horizontally winding and unwinding wire strand in existing technology can be commendably solved with present invention, and it could remarkably increase cable strand erection effect and quality of winding and unwinding cable strand. The advantageous effects of present invention are: reasonable arrangement of operating sequence, winding cable strand, loop formation, package and transportation and unwinding cable strand are completed in one breath, decrease work intensity and time; cable strand loop formation is in regular compactness arrangement, all winding cable strand and unwinding cable strand operations can go with a swing; when unwinding strand it can eliminate the trauma from falling down phenomena, have no skill in damage cable strand and its binding band; increase degree of automation, and real-time monitoring correlated data, decrease people laboring, increase security; shipping reel utensil lightweight, have no need for large size reel utensil, save plenty manufacture and transportation costs.

DETAILED DESCRIPTION OF THE EMBODIMENTS OF THE INVENTION

The present invention will be illustrated by the following concrete embodiments.

Figure 1:
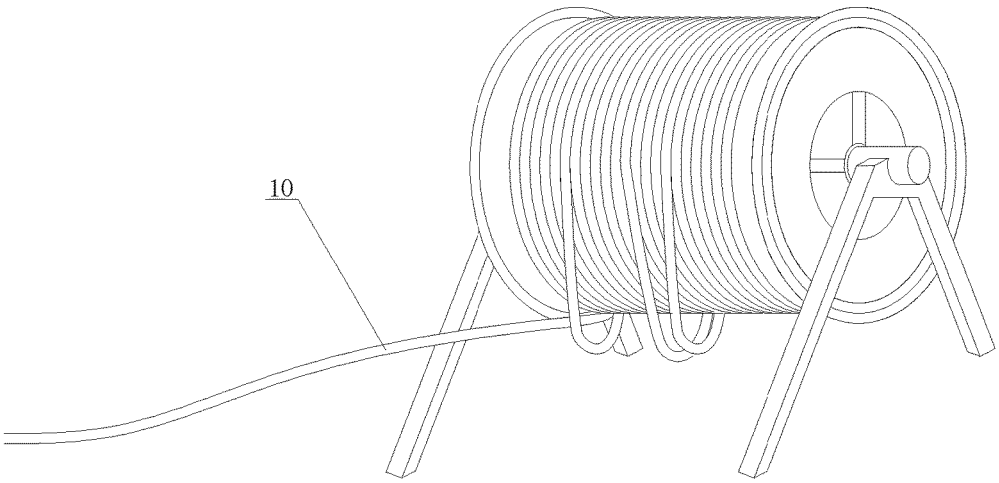
FIG. 1 (PRIOR ART)
FIG. 1 is a structure schematic for the strand drop phenomenon in the existing technology.
Figure 2:
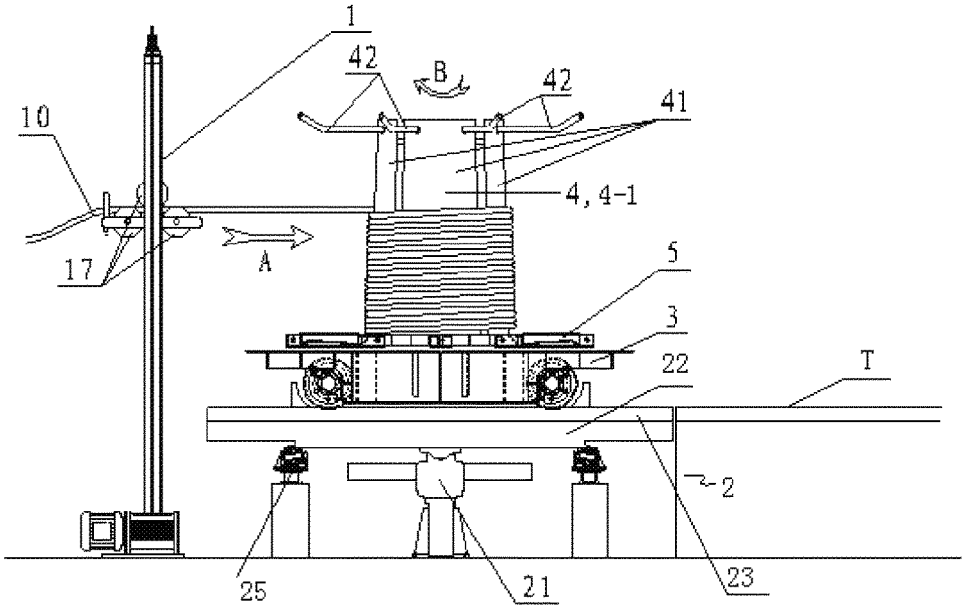
FIG. 2 is a structure schematic for strand winding on the inner module when winding strand.
Figure 3:
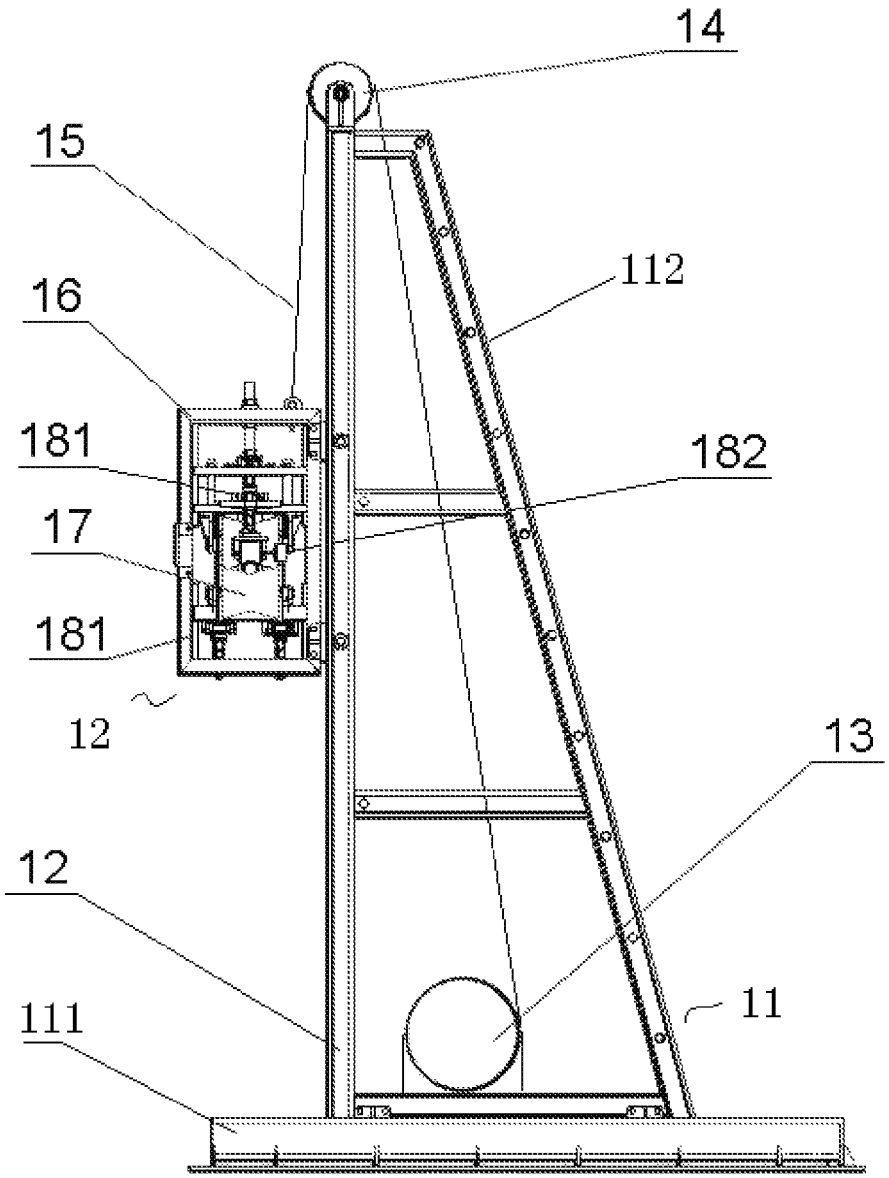
FIG. 3 is the front view of the guide device in this invention.
Figure 4:
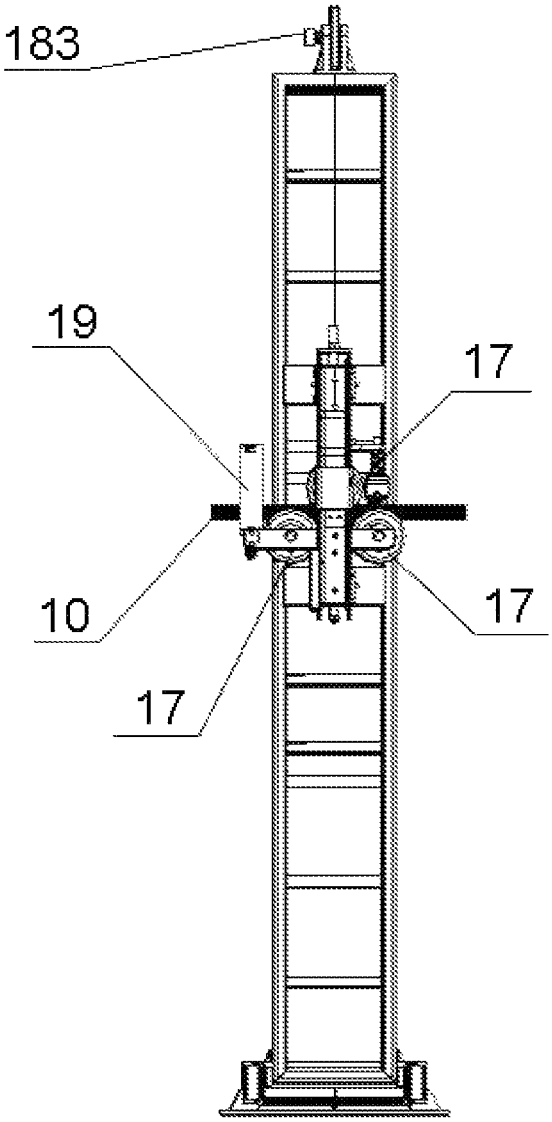
FIG. 4 is the left view of the guide device in this invention.
Figure 5:
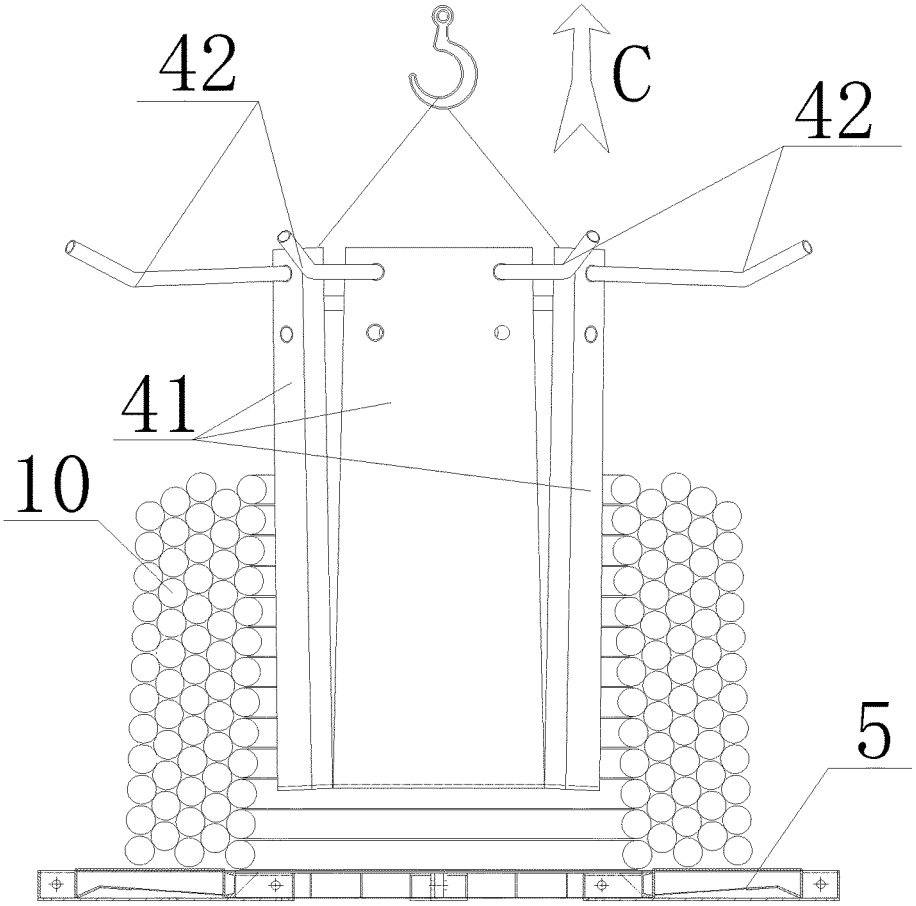
FIG. 5 is a structure schematic for extraction of the inner module when winding strand finished.
Figure 6:
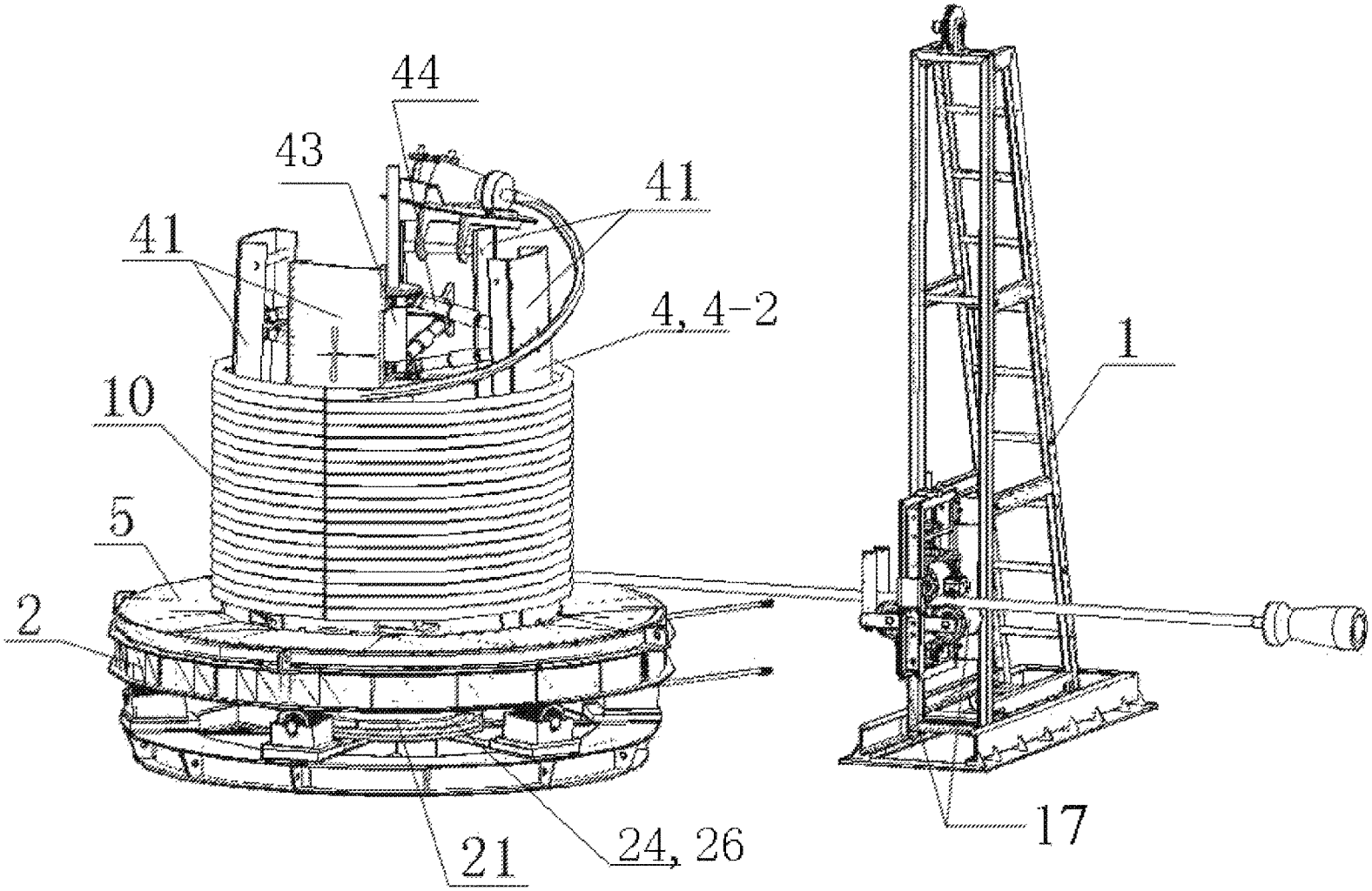
FIG. 6 is a structure schematic for straighten of the strand wire strands when unwinding strand.

Please refer from FIG. 2 to FIG. 6, the device for horizontally winding and unwinding wire strand of present invention, including: guiding device 1 of strand 10, rotating platform 2, rail flat wagon 3, strand winding and unwinding device 4, tray 5, several transmitters and programmable controllers, wherein, said guide frame 11 which is constituted by base 111 and supporting frame 112, electric wire hoist 13 fit on base 111, fixed pulley 14 mounted at the top of the supporting frame 112, includes crane 16 and lifting appliance 12 composed of the strand transfer control mechanism set in the crane, a wire rope 15 which connects from electric wire hoist 13 to the top surface of crane 16 bypass around fixed pulley 14, wherein the said strand transfer control mechanism includes roller 17 and spacing wheel 19, wherein there are three rollers 17 installed in the crane 16, and arranged in "品" character pattern, that is to say, the three connecting lines from each center of circle of three rollers 17 make up of a triangle (according to common practice, there should remain a pore space which is overpassed by cable strand between three rollers), said guiding device 1 is vertically installed on the ground through guiding frame 11; said spacing wheel 19 of cable strand transfer control mechanism is fitted at one side leading strand 10 by three rollers 17 of crane 16;

rotating platform 2 includes the under-chassis, turning axle 21 vertically fixed on under-chassis centre, platform 22 set on turning axle 21, platform rails 23 which are laid on platform 22 and connected to external rail T outside the platform, several backup pieces surrounding said turning axle 21 vertically set on the under-chassis, said backup pieces are installed at the bottom surfaces of platform 22 to constitute revolving wheels 25 which assume contact connect and rolling support function to assist platform 22 smooth running; rotating, platform 2 is fitted on the ground by the side of guiding device; in this embodiment, when platform 22 of rotating platform which is rotating round turning axle 21, the surface of platform 22 should keep flush with ground, Said rotating platform 2 still including a hydraulic brake 24 installed around turning axle 21 and a brake pressure transmitter 26 installed at one side of hydraulic brake 24, the brake pressure transmitter is also connected with said programmable controller. So, the winding of cable strand is set bounds through management of programmable controller, to prevent cable strand out of control, bring about cable strand damage or people injuries and deaths; when in unwinding cable strand operation, line shape will keep relatively straighten, to protect cable strand and prevent breakdown; when the speed of unwinding cable strand is slowed down or stop, gradually control hydraulic brake 24 to lock turning axle; the induction of brake pressure transmitter can more easy to control hydraulic brake 24 by programmable controller.

rail flat wagon 3 is a special car which is used for winding cable strand, comprising: wheels and bedplate etc. they all fit on upward side of wheel through supporting frame, and set located on platform rail 23 through wheel, in order to remove wrapped cable strand 10 through platform rail 23; owing to rotating platform 2 is possessed of turning performance, therefore rail flat wagon 3 can be easy to select external rail T connection by multi directions, such as abutting joint with workshop rail.

strand winding and unwinding device 4 is equipped with two structure forms according to different installations and processing characteristics for horizontally parallel wire strand winding and unwinding, so, the device will be used for winding strand for horizontally parallel wire strand winding and unwinding is named for first inner module 4-1, and the device will be used for unwinding strand for horizontally parallel wire strand winding and unwinding is named for second inner module 4-2, wherein, the first inner module 4-1 is composed of four pieces of bracing plate 41 at least and four opposite top drawbars 42 at least, wherein the bottom of bracing plate 41 and upper surface of rail flat wagon 3 bedplate are connected with bolts and hinges firmly, assuming cellular pattern arrangement and uniform distribution, in this installation form, there is a gap clearance between two adjacent bracing plates 41, and on both right and left sides of push pawl 41 upper part, two drawbars 42 which are used as lifting eye for removing push pawl 41 are symmetrically fixed on top of each push pawl 41 through hinges, after push pawl 41 and rail flat wagon 3 are fixed joint, the gravity center of each push pawl 41 is located at outer side of respective hinge, whereas top section of each push pawl 41 is outward dipping to a certain angular degree, said supporting plate 41 will outward dip to a certain angular degree which is a included angle constituted from outer surface of supporting plate 41 and upper surface of rail flat wagon 3, commonly for between 60°~85° (in doing so, the pull lead from bedplate centre should be perpendicular to lower band of per supporting plate 41, taking this procedure as one of necessary mounting frames for winding cable strand operation;

second inner module 4-2 is composed of four supporting plates 41 at least, four pair top section drawbars at least, hydraulic jack 43 and four pieces of pushing bar 44 at least, wherein the bottom of supporting plate 41 and upper end of platform 22 are mounted with bolts and hinges and assume cellular pattern arrangement and uniform distribution; in this installation status, there is a gap clearance between two adjacent bracing plates 41, top drawbars 42 are fixed on both right and left sides of push pawl 41 upper part through hinges, after push pawl 41 and platform 22 are firmly connected, the gravity center of push pawl 41 is located at inner side of respective hinge, forcing the top section of supporting plate 41 to lean inward to a certain angular degree; hydraulic jack 43 is fitted on platform 22 of supporting plate 41 centre, one end of pushing bar 44 is connected with knockout-pin of hydraulic jack 43, the other end comes into contact with internal surface of center position of supporting plate 41, resisting each supporting plate 41, so, said top section of said supporting plate 41 will inward dip to a certain angular degree which is a included angle constituted from inner surface of supporting plate 41 and upper surface of platform 22, commonly for between 60°~85°, (in doing so, the center line of platform 22 should be perpendicular to lower band of per supporting plate 41), taking this procedure as one of necessary mounting frames for unwinding cable strand operation.

No matter whether first inner module 4-1 or second inner module 4-2, the gap length between supporting plates 41 is 80%~150% of supporting plate 41 width.

in one embodiment, if four supporting plates 41 are set, the gap clearance between supporting plates 41 can be taken as 150% of supporting plate 41 width, in order to supply operating personnel to roomily get into insides of first inner module and second inner module to carry out operations.

supporting plates 41 of first inner module and second inner module are possessed of definite intensity and flexibility properties for keeping cable strand 10 tightening force, commonly supporting plate 41 will select to use plates made of mild steel, medium steel or low-carbon alloy steel etc. Their thickness is 7-12 mm.

In another embodiment, a method of operating the device for horizontally winding and unwinding wire strand, including winding and unwinding wire strand operations. When it is in winding wire strand operation, inner module 4 is composed of six pieces of bracing plates 41 and six opposite top drawbars 42, six pieces of bracing plates 41 assume cellular pattern arrangement and uniform distribution, there remains gap clearance between adjacent supporting plates 41, the gap length is 100% of supporting plate 41 width.

In one more embodiment, a method of operating the device for horizontally winding and unwinding wire strand, including winding and unwinding wire strand operations. When it is in winding wire strand operation, inner module 4 is composed of ten pieces of bracing plates 41 and six opposite top drawbars 42, six pieces of bracing plates 41 assume cellular pattern arrangement and uniform distribution, there remains gap clearance between adjacent supporting plates 41, the gap length is 80% of supporting plate 41 width.

said tray 5 is a circular ring appear board which will be sit in bedplate of rail flat wagon 3 in winding operation or directly sit in platform 22 in unwinding operation, and fit outside of strand winding and unwinding device 4 in both strand winding and unwinding operations, there are lifting points at the edge of tray 5, used for lift tray and looped cable strand thereon after cable strand is in loop formation. Furthermore, in winding operation a water proof membrane cover will be laid on top surface of tray 5, so as after winding cable operation is fulfilled, the looped cable strand 10 will be completely wrapped.

said transmitter including pressure sensor 181, velocity measurement encoder 182 and altitude measurement encoder 183, wherein pressure sensor 181 and velocity measurement encoder 182 are set at one side of roller 17; altitude measurement encoder 183 is set at one side of fixed pulley 14;

programmable controller is used for linking and controlling pressure sensor 181, velocity measurement encoder 182 altitude measurement encoder 183 as well as hauling wire rope 15 to pull up crane 16 of electric wire hoist 13.

A method of operating the device for horizontally winding and unwinding wire strand of present invention, including winding and unwinding wire strand operations, said operations are characterized comprising:

In winding strand operation, according to following steps carry out in sequence:

step 1, guiding device 1 of cable strand 10 and rotating platform 2 are installed respectively on the ground and take their places, connect electric wire hoist 13 pressure sensor 181 at one side of rollers, and logging speed encoder 182, as well as altitude measurement encoder 183 at one side of fixed pulley 14 with programmable controller through wire to electrically connected.

step 2, along platform 23 the rail flat wagon 3 is pushed into and fix to platform 22.

step 3, strand winding and unwinding device 4 is installed by means of first inner module 4-1 mode, use four supporting plates 41 and thereon each plate sets up a pair of top drawbars 42, then the bottom of supporting plate 41 is fitted on bedplate of rail flat wagon 3 with bolts or hinges, assuming cellular pattern arrangement and keeping gap clearance between two neighbor supporting plates 41 apart, as well as their upper ends outward dipping;

step 4, a water proof membrane cover should be laid on the upper surface of said tray 5 in advance, then said tray 5 should be placed on bedplate of rail flat wagon 3 by means of fitting over first inner module 4-1 outside;

step 5, after the head end of cable strand 10 passes through rollers 17, it will fix to supporting plate 41 of first inner module 4-1, it drives rotating platform 2 to rotate and makes rail flat wagon 3 and supporting plate 41 to rotate all together, the cable strand 10 will be gradually enlaced on push pawl 41 by looping, during enlacing it will loop upwards from bottom of push pawl 41 to top of push pawl (41), when it reaches the top of push pawl 41, it will loop downwards. When each turn of cable strand goes around supporting plate 41, inner surface of supporting plate 41 develops elastic deformation towards center line of bedplate of rail flat wagon, whereas the cable strand will take up on supporting plate 41. Thus repeated until all cable strands 10 are enlaced in loop formation;

In a preferred embodiment, in said step 5, when cable strand 10 enlaces upwards in every turn, programmable controller controls electric wire hoist 13 to draw wire rope 15 to pull crane 16 up, forcing guide roller 11 upwards to move a distance which is equal to diameter of strand 10; when cable strand 10 enlaces downwards in every turn, programmable controller controls electric wire hoist 13 to draw wire rope 15 to pull crane 16 down, forcing guide roller 11 downwards to move a distance which is equal to diameter of strand 10.

step 6, after all cable strands 10 are enlaced in loop formation, the screw bolts fixed and jointed between the bottom of internal stay plate 41 and rail flat wagon 3 are stripped down, lift the drawbar 42 at top section of push pawl 41 with lifting rope to force push pawl 41 to furl inward, and pull out from the looped cable strand 10, the water proof membrane cover which is laid on upper surface of tray 5 originally will completely pack the looped cable strand 10.

step 7, connect platform rail 23 laid on rotating platform 2 to ground rail T, drawing rail flat wagon 3 will shift away looped cable strand 10, complete one winding strand operation.

Repeat the above-mentioned operations can fulfill many looped cable strands 10 from horizontally winding parallel wire strand.

In unwinding strand operation, carry out the following steps in sequence:

step 8, guiding device of cable strand 10 and rotating platform 2 are face to face installed in their respective places on the ground, electric wire hoist 13 pressure sensor 181 and velocity measurement encoder 182 at one side of rollers, as well as altitude encoder 183 at one side of fixed pulley 14 are electrically contacted through wires;

step 9, strand winding and unwinding device 4 is installed by means of second inner module 4-2 mode, use four supporting plates 41, then the supporting plates 41 equipped with top section drawbar 42 are lifted on platform 22 of rotating platform 2, the bottom of supporting plate 41 is fitted on platform with hinges, assuming cellular pattern arrangement and keeping gap clearance between two neighbor supporting plates 41 apart, as well as their upper ends inward dipping;

step 10, a hydraulic jack 43 is fixed on platform 22 under the centre of supporting plate 41, the knockout pin of hydraulic jack connects four pushing bars 44, all of the pushing bars 44 are resisted at the upside position of a piece of supporting plate 41 centre;

step 11, remove water proof membrane cover which is wrapped around outside of looped cable strand 10, then should lift looped cable strand 10 together with tray 5 by means of housing outside second inner module 4-2 to platform 22 of rotating platform 2;

step 12, start hydraulic jack 43 to push pushing bar 44 to move upward through knockout pin, forcing supporting plate 41 open outward to fix looped cable strand 10;

step 13, lead one end of looped cable strand 10 out of guide rollers 17, pull cable strand 10 to force looped cable strand 10 to drive second inner module 4-2, furthermore to drive tray 5, and to drive rotating platform 2 to rotate around turning axle 21. When unwinding every one turn cable strand from 41, under the sustained action of hydraulic jack, inner surface of supporting plate 41 develops elastic deformation far from center line of rotating platform 2, to release cable strand from its tightened state. In consequence the cable strand 10 will be by every loop released in straight line state from looped formation state piece by piece.

In a preferred embodiment, in step 13, said cable strand 10 releases one loop of strand downwards at a time, the programmable controller will control electric wire hoist 13 to draw wire rope 15 to pull crane 16 downwards, making the distance which is moved downwards by rollers 17 is equal to the diameter of strand 10; cable strand 10 releases one loop of strand upwards at a time, the programmable controller will control electric wire hoist 13 to draw wire rope 15 to pull crane 16 upwards, making the distance which is moved upwards by rollers 17 is equal to the diameter of strand 10, the cable strand can afford to arrange compacted in steel internal bladder regularly, in such a way repeat the operation until looped cable strand 10 will be all released in straight line state to fulfill unwinding cable strand operation.

In another preferred embodiment, in step 13, still including during the unwinding cable strand is set bounds to speed lowing of unwinding strand or stop, it can adopt the control of programmable controller, gradually control hydraulic brake 24 to lock turning axle; that is to say, through transferring message of pressure sensor 26 into programmable controller to conduct management for hydraulic brake 24.

What is claimed is:

1. A device for horizontally winding and unwinding cable strand comprising:

a guiding device (1) of cable strand (10) for guiding a cable strand moving up and down during winding operation;

a cable strand winding and unwinding device (4) for winding or unwinding the cable strand as a cable strand roll;

a rotating platform device (2) for supporting and rotating the cable strand winding and unwinding device (4) in unwinding operation;

a rail wagon (3) for supporting and moving the cable strand winding and unwinding device (4) in winding operation, a tray (5) for containing cable strand roll thereon and able to lift both the tray and the cable strand roll;

a controlling device for controlling actions of the guiding device, the cable strand winding and unwinding device;

the guiding device (1) comprises:

a guide frame (11) constituted by a base (111) and a supporting frame (112), an electric cable hoist (13) fit on the base (111), a fixed pulley (14) mounted at a top of the supporting frame (112), a lifting appliance (12) includes a crane (16) and a strand transfer control mechanism set in the crane, the crane (16) is pulled by said electric cable hoist (13), a wire rope (15) which connects from said electric cable hoist (13) to the top surface of said crane (16) bypass around said fixed pulley (14), the strand transfer control mechanism includes three rollers (17) and a spacing wheel (19), connecting three centers of the three rollers (17) becomes a triangle;

the rotating platform device (2) located a side of the guiding device (1) comprises:

an under-chassis, a turning axle (21) fixed to a centre of the under-chassis, a platform (22) set on the turning axle (21) and supported by revolving wheels (25), platform rails (23) laid on the platform (22) and connected to an external rail outside the platform;

the rail wagon (3) comprising:

wheels and a bedplate on the wheel through a supporting frame, the rail wagon (3) is on the platform rail (23) in order to remove a roll of wrapped cable strand from the rotating platform device (2);

the cable strand winding and unwinding device (4) comprises:

four pieces of bracing plate (41), there is a gap clearance between two adjacent bracing plates (41), four pair of top drawbars (42), each bracing plate (41) has two drawbars (42) which are located severally on a top of the bracing plate (41), in winding operation, bottoms of the bracing plates (41) provided with the drawbars are turnablely hinged with the bedplate of the rail wagon (3) by bolts, or in unwinding operation, bottoms of the bracing plates (41) provided with the drawbars are turnablely hinged with the platform (22) of the rotating platform device (2) by bolts;

the tray (5) comprises:

a circular ring sitting on the bedplate of the rail wagon (3), edge of the tray (5) has lifting points; and the controlling device comprises:

a pressure sensor (181), a velocity measurement encoder (182) and an altitude measurement encoder (183), wherein the pressure sensor (181) and the velocity measurement encoder (182) are set at one side of roller (17); the altitude measurement encoder (183) is set at one side of fixed pulley (14);

a programmable controller, which is used for linking and controlling the pressure sensor (181), the velocity measurement encoder (182), the altitude measurement encoder (183) and for hauling the wire rope (15) to pull up the crane (16), when the cable strand (10) being enlaced upwards in every turn, the programmable controller controls the electric cable hoist (13) to pull the crane (16) up to move along the guide frame (11) upwards a distance which is equal to a diameter of the cable strand (10), when the cable strand (10) being enlaced downwards in every turn, the programmable controller controls the electric cable hoist (13) to pull the crane (16) down to move along the guide framer (11) downwards a distance which is equal to diameter of the cable strand (10).

2. The device of claim 1, wherein said spacing wheel (19) is set on the crane (16) located adjacently at one side of the cable strand (10) which is pulled out from the three rollers (17).

3. The device of claim 1, wherein said rotating platform (2) includes a hydraulic brake (24) installed around the turning axle (21) and a brake pressure transmitter installed at one side of the hydraulic brake (24), the brake pressure transmitter is also connected with said programmable controller.

4. The device of claim 1, wherein said cable strand in winding operation, the top section of said bracing plate (41) will turn outward a certain angular degree to form an included angle between an outer surface of the bracing plate (41) and an upper surface of the rail wagon (3) from 60°~85°.

5. The device of claim 1, wherein said wire strand in unwinding strand operation, the top section of said supporting plate (41) will inward a certain angular degree to form a included angle between an inner surface of the bracing plate (41) and an upper surface of the platform (22) from 60°~85°.

6. The device of claim 1, wherein there are gap clearances between adjacent two bracing plates (41), and a width of the gap is 80%~150% of a width of the bracing supporting plate (41).

7. The device of claim 1, wherein the bottoms of the bracing plates (41) are turnablely hinged with the bedplate of the rail wagon (3) by bolts, a gravity center of each bracing plates (41) is located at outer side of the bolt respectively, the top section of each bracing plates (41) is outward declining to a certain angular degree.

8. The device of claim 1, wherein the strand winding and unwinding device (4) also includes a hydraulic jack (43) and four pieces of pushing bar (44), wherein, the hydraulic jack (43) is fitted on a center of the platform (22), one end of the pushing bar (44) is connected with a knockout-pin of the hydraulic jack (43), the other end comes into contact with an internal surface of the bracing plate (41), the hydraulic jack (43) push the bracing plate (41) by the pushing bar (44) to move outward the bracing plate (41), so that resisting the each bracing plate (41) therefrom in unwinding operation.

* * * * *